US007017603B1

(12) United States Patent
Rosine et al.

(10) Patent No.: US 7,017,603 B1
(45) Date of Patent: Mar. 28, 2006

(54) HOSE REEL CART WITH TRAY CONSTRUCTED FROM PLASTIC AND METAL STRUCTURAL COMPONENTS

(75) Inventors: Lyle A. Rosine, Batavia, IL (US); Torrence Anderson, Overland Park, KS (US)

(73) Assignee: Suncast Corporation, Batavia, IL (US)

( * ) Notice: Subject to any disclaimer, the term of this patent is extended or adjusted under 35 U.S.C. 154(b) by 0 days.

(21) Appl. No.: 10/991,034

(22) Filed: Nov. 16, 2004

(51) Int. Cl.
*A01M 7/00* (2006.01)

(52) U.S. Cl. ..... 137/355.12; 137/342; 137/355.2; 137/355.26; 242/395.1; 242/398

(58) Field of Classification Search ..... 137/355.2, 137/355.12, 342, 355.26; 242/395.1, 398
See application file for complete search history.

(56) References Cited

U.S. PATENT DOCUMENTS

| | | | | | |
|---|---|---|---|---|---|
| 2,595,655 | A | * | 5/1952 | Hannay | 242/390 |
| 2,640,724 | A | * | 6/1953 | Wiens et al. | 137/259 |
| 2,963,227 | A | * | 12/1960 | Lambert | 239/197 |
| 4,540,017 | A | * | 9/1985 | Prange | 137/355.12 |
| RE32,510 | E | | 9/1987 | Tisbo et al. | |
| 4,763,799 | A | | 8/1988 | Cohn et al. | |
| 4,777,976 | A | | 10/1988 | Johnston et al. | |
| 4,838,302 | A | * | 6/1989 | Prange | 137/355.12 |
| 5,007,598 | A | | 4/1991 | Spear et al. | |
| 5,046,520 | A | | 9/1991 | Sanchez, Jr. et al. | |
| 5,425,391 | A | | 6/1995 | Tisbo et al. | |
| 5,704,384 | A | | 1/1998 | Tisbo et al. | |
| 5,758,685 | A | | 6/1998 | Tisbo et al. | |
| 5,887,878 | A | | 3/1999 | Tisbo et al. | |
| 5,901,730 | A | | 5/1999 | Tisbo et al. | |
| 5,998,552 | A | | 12/1999 | Gruber et al. | |
| 6,050,291 | A | * | 4/2000 | Whitehead et al. | 137/355.26 |
| 6,086,073 | A | | 7/2000 | Tisbo et al. | |
| RE37,442 | E | | 11/2001 | Spear et al. | |
| 6,338,360 | B1 | * | 1/2002 | Spear et al. | 137/355.22 |
| 6,834,670 | B1 | * | 12/2004 | Rosine et al. | 137/355.27 |

* cited by examiner

*Primary Examiner*—A. Michael Chambers
(74) *Attorney, Agent, or Firm*—McHale & Slavin, P.A.

(57) ABSTRACT

The present invention relates to portable hose reel carts for handling and storage of large lengths of flexible hoses, such as garden or air hoses. The cart is constructed of plastic and steel components having a centrally rotatable spool for winding of the flexible hose, a frame for supporting the spool, wheels at each end of the base of the frame, and a handle assembly attached to the frame to facilitate moving the cart. The crank handle assembly which may or may not be foldable for easy storage. The cart includes a large tray for storage and transport of garden supplies.

16 Claims, 12 Drawing Sheets

HOSE REEL CART WITH TRAY CONSTRUCTED FROM PLASTIC AND METAL STRUCTURAL COMPONENTS

FIELD OF THE INVENTION

This invention pertains to carts for use in storage of flexible hoses, and more particularly to a hose reel cart having structural components made from both metal and plastic thereby creating a lightweight and durable hose reel cart having improved stability and maneuverability.

BACKGROUND INFORMATION

Portable hose reel carts for handling and storage of flexible elongate tubular members, such as garden hoses, air hoses and the like, have gained wide public acceptance. While the construction of hose reel carts is quite varied, such carts are primarily constructed entirely from metal or entirely of molded plastic components. Hose reel carts generally have a centrally disposed rotatable spool and crank handle for reeling of the flexible hose, a frame for supporting the spool rotatable by a crank, two wheels at one end of the base of the frame, and a frame handle for tilting the frame onto the two wheels to facilitate moving the cart. The frame handle and/or crank handle may or may not be foldable for purposes of shipping and/or storage. For more information concerning the structure and operation of hose reel carts, reference may be made to U.S. Pat. No. RE. 32,510, the teachings of which are hereby incorporated by reference.

It is generally recognized that hose reels are often stored outside and thus are subjected to the adverse elements, e.g. hot and cold temperatures, rain, snow, ice and dirt. It has been found that hose reel carts formed exclusively from molded plastic or polymeric material are lightweight and resistant to corrosion caused by the elements. However, the plastic structures are currently unable to withstand the elements for extended periods of time without becoming brittle or warping. It has also been found in practice that prior art hose reel carts made predominantly of metal are robust and sturdy. However, metal hose reel carts have a tendency to corrode when their protective surface becomes damaged or worn away through usage.

It is also generally recognized that some end users may drain fluid from the hose prior to rewinding it about the hose spool while others rewind the hose about the spool while it is still full of water. Each situation creates its own unique set of problems. Lightweight polymeric structures are generally unable to withstand the weight of large amounts of filled water hose and thus are limited in size and/or hose capacity. Still yet, many of these polymeric hose reel structures are not able to withstand the peripheral forces transmitted to a hose reel when an empty hose is communicated with a fluid source under pressure while still wound around the reel. Often, the repeated application of such forces results in structural failure of the hose spool.

Hose reel carts constructed predominantly of metal are robust and sturdy, and able to accommodate repeated application of peripheral forces. However, these carts tend to be exceptionally heavy, making them less amenable to being pushed or pulled by the user over rough surfaces. Large amounts of heavy filled hose compound the problem of portability and are likely to raise the center of gravity. The raised center of gravity may make the cart easy to tip over and dangerous for the user.

Additionally, most of the prior art hose reel carts, whether plastic or steel, utilize injection molded hard plastic tires.

While these tires are lightweight and inexpensive to manufacture, they are often prone to damage, especially when used directly upon rough surfaces, such as gravel, sand or brushed concrete. Additionally, plastic tires do not respond well to static or dynamic loads when used on soft surfaces. That is, as the load increases the tread width remains the same allowing the tire to sink into the surface. In contrast, floatation tires, such as rubber pneumatic tires, provide compression. As the compressive load increases the tire gets wider, increasing the hose reel footprint. The increased footprint allows the cart to float over soft surfaces and reduces the forces required to move the cart.

To this end, what is needed in the art is a portable hose reel cart capable of storing a large amount, e.g. more than 150 feet, of filled or unfilled hose. The hose reel cart should be capable of withstanding adverse conditions for extended periods of time without warping or cracking. The hose reel cart should have a supporting enclosure able to provide optimum strength while maintaining minimal weight through the use of both plastic and metal components. The hose reel cart should include durable pneumatic tires for increased load portability across soft and rough surfaces.

The present invention utilizes four plastic coated metal corner-posts, floatation tires and hollow metal transverse frame members that are tightly fitted or integrally molded into plastic side frame members for lightweight yet durable construction. Utilization of the combination of plastic and metal permits the construction of large lightweight portable hose reel carts when compared to those taught by the prior art. As used herein the terms "plastic coated metal" and "metal reinforced polymeric structural panel" refers to a structural component formed from one or more polymeric resins in combination with at least one metallic reinforcing structure. The polymeric portion of the component may be formed to tightly accept the metallic structure after molding or the polymeric portion of the component may be molding around the metallic structure. U.S. Pat. No. 5,007,598 illustrates a commonly found portable hose cart including a molded plastic handle connected to the plastic frame sides. This disclosure requires the user place their foot behind a rear bar and pull the handle rearwardly and down such that the cart can be tilted to such a degree as to allow the front feet of the cart to be lifted off the ground and onto the two back wheels in order to transport it from location to location. It can be difficult for a user of small stature to tip the hose laden cart backward, as well as dangerous should the user tip the cart too far back causing the cart to topple over on top of them.

Similarly, U.S. Pat. No. 6,338,360 shows a hose reel carrier assembly with a tray for storage. The cart also has two plastic wheels which can be mounted on common or separate axles. In order to move this hose carrier, the user must lift the side opposite of the wheels upward by a handle, such that the feet underneath the handle are off the ground. In order to move it forward, the user must then push against the carrier while still lifting the weight of the carrier and hose, making it extremely difficult for many individuals to use, especially on uneven or rough terrain.

"Suncast Metal Hose Reel" model no. MHR300 illustrates a metal frame construction capable of holding 300 feet of hose on four pneumatic wheels. Similarly, the Ames® "Steel Hose Caddy" model no. HR93 illustrates a similar solid steel construction for storage of 200 ft of ⅝ inch hose on two pneumatic 20 inch rear tires with two smaller front tires. However, these hose carts do not include a tray to carry garden tools. Additionally, the cart frames are made entirely of metal making them heavy, especially when laden with over 150 feet of hose, and therefore not easily transported across uneven or soft ground.

While the foregoing described prior art devices have improved the art and in some instances enjoyed commercial success, there remains nonetheless a continuing need in the art for a corrosion resistant lightweight hose reel cart with tray, which uses a combination of polymeric and steel components of stable construction so as to support large lengths of hose and other garden accessories while maintaining the portability to be easily navigated over difficult terrain without having to tilt the cart.

SUMMARY OF THE INVENTION

The hose reel cart of the present invention utilizes construction consisting of plastic and steel components for increased durability and stability while still remaining lightweight for increased hose capacity and portability. By utilizing four plastic coated steel corner-posts, floatation tires, and hollow steel transverse frame members that are fitted or integrally molded into plastic side frame members, a lightweight yet durable hose reel cart may be constructed. Additionally, the hose reel cart is provided with corrosion resistant plastic wheels. The wheels are provided with roller bearings for ease of mobility. The hose reel cart may be preassembled at the factory thereby eliminating the need for assembly and associated product packaging. The hose is wound around the spool by use of a crank providing a direct rotational link between the crank and the winding of the spool. During non-use, a handle on the crank is placed into a storage position by pivoting the handle about one end of the crank arm. Moreover, the crank arm and handle can be positioned on either side of the frame providing left or right handed operation. Utilization of the combination of plastic and steel permits the construction of large lightweight portable hose reel carts.

Thus, an objective of the instant invention is to provide a readily portable hose reel cart wherein all components are preassembled so as to eliminate the need for assembly by the consumer, yet allow repeatable storage by providing for the use of a foldable crank handle.

Another objective of the invention is to provide a portable hose reel cart utilizing a combination of molded plastic and plastic covered metal components for improved corrosion resistance, strength and rigidity.

A further objective of the present invention is to provide a portable hose reel cart with tray atop a combination plastic and steel frame structure having four large floatation tires to easily transport heavy and/or large lengths of hose across uneven or rough terrain.

Other objectives and advantages of this invention will become apparent from the following description taken in conjunction with the accompanying drawings wherein are set forth, by way of illustration and example, certain embodiments of this invention. The drawings constitute a part of the specification and include exemplary embodiments of the present invention and illustrate various objectives and features thereof.

DETAILED DESCRIPTION OF THE PREFERRED EMBODIMENT

Figure 1:
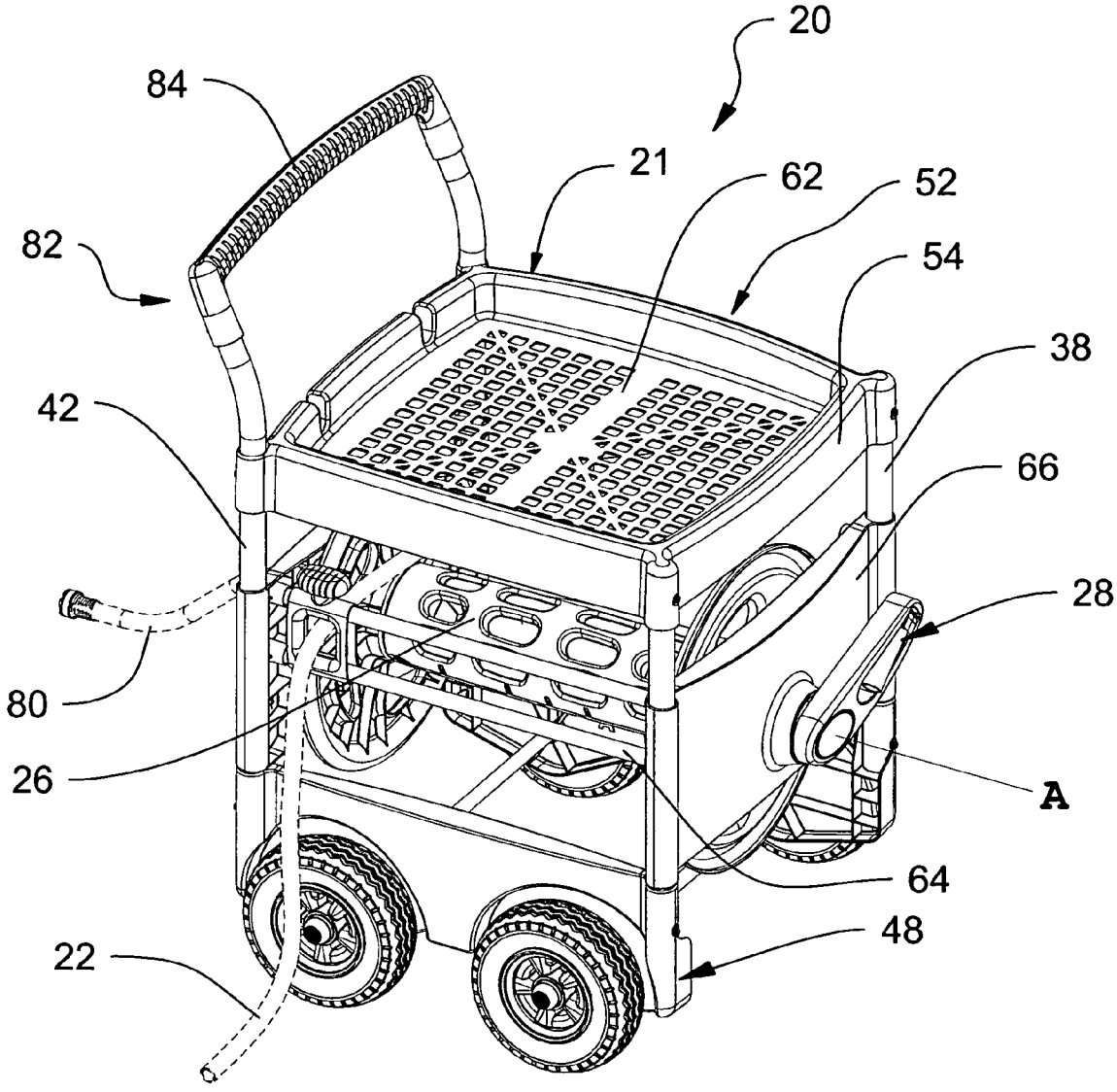
FIG. 1 is a front perspective view of the instant invention.

Referring now to FIGS. 1–8, wherein like elements are numbered consistently throughout, there is shown a portable hose cart generally indicated by the reference number 20, embodying the principles of the present invention. The hose reel cart 20 is useful for holding, paying out and transporting large amounts of hose 22 between a storage location and a use location. The major components of the hose reel cart include an enclosure assembly 21, a spool or reel assembly 26 coupled to a crank handle assembly 28, a tray 52, a handle member 82 and four of wheel assemblies 48. In a typical arrangement, the cart 20 is able store upwards of 300 feet of a ⅝ inch common hose on the reel 26.

Figure 2:
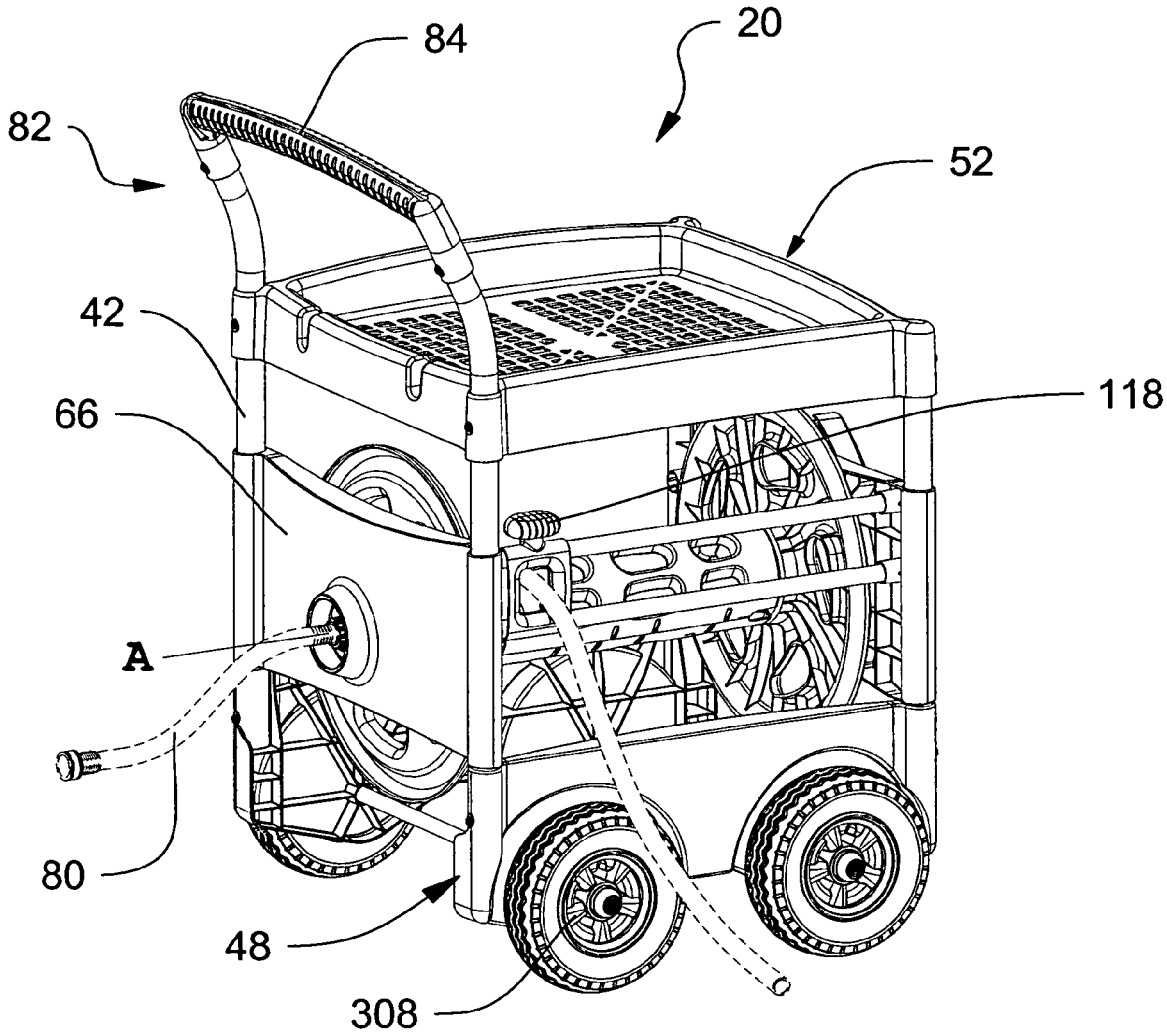
FIG. 2 is a rear perspective view of the instant invention.
Figure 3:
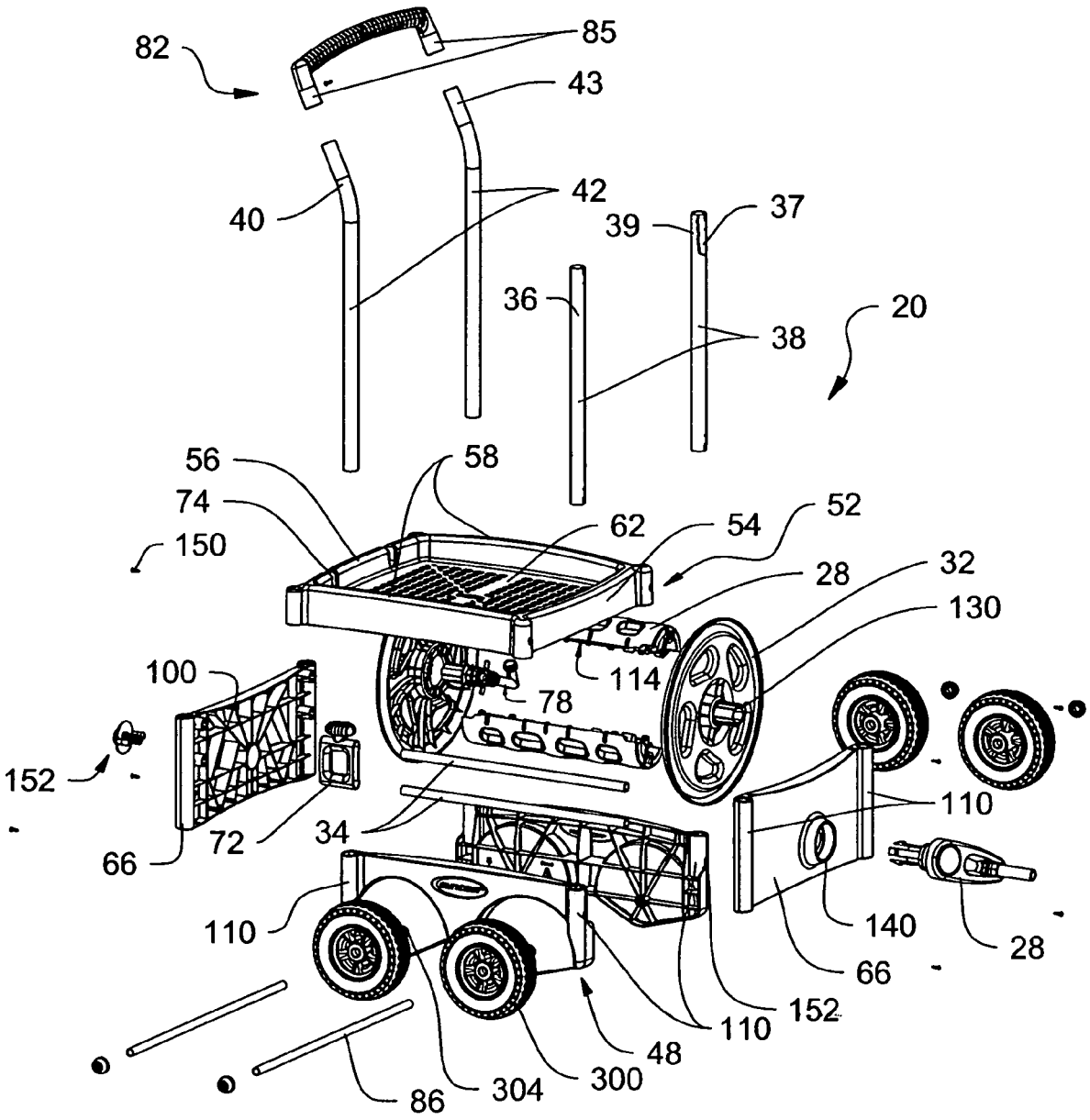
FIG. 3 is an exploded view of the instant invention.
Figure 4:
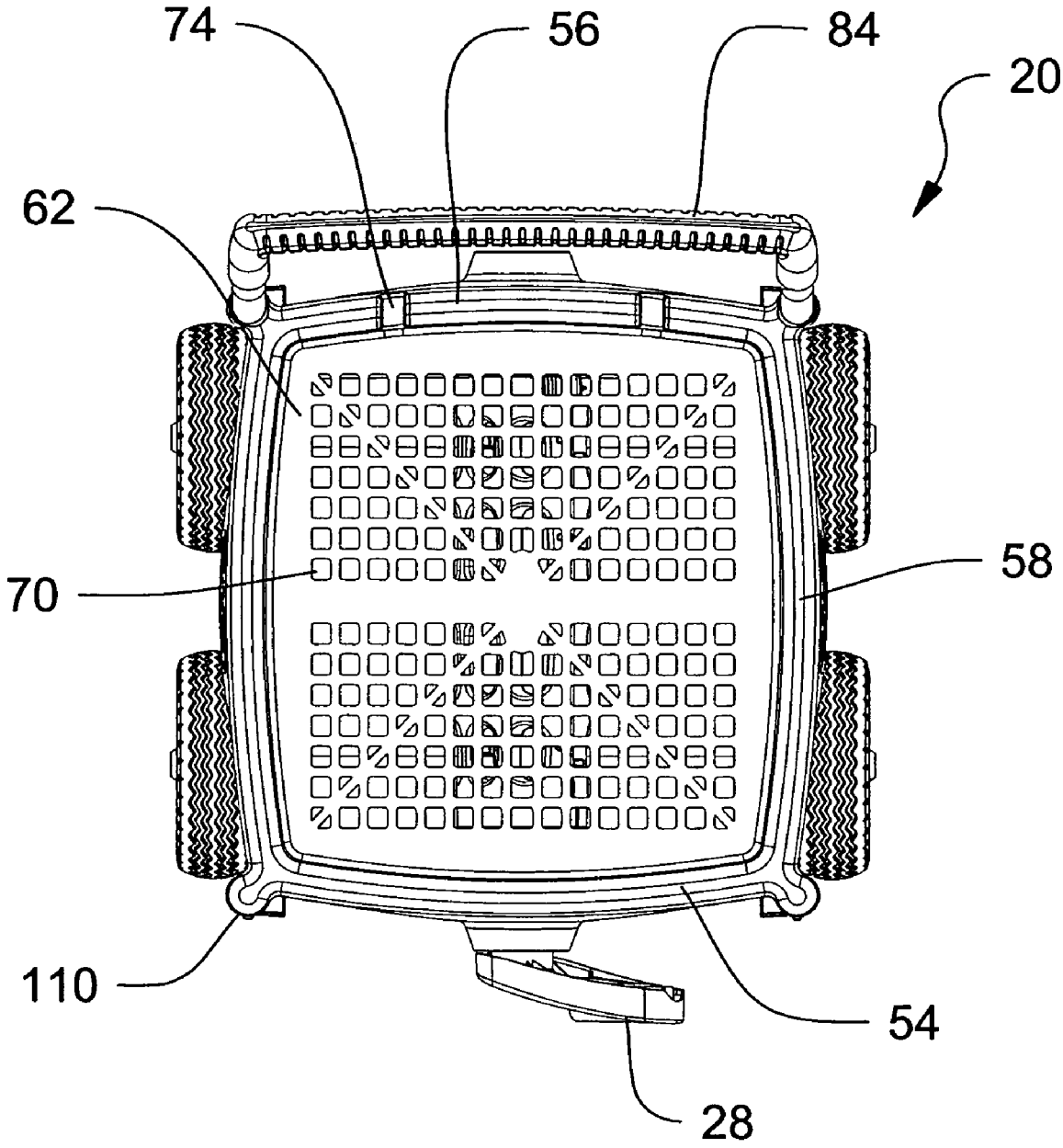
FIG. 4 is a top view of the instant invention.

The enclosure assembly 21 includes a pair of generally vertical front support posts 38 and a pair of generally vertical rear support posts 42. The support posts are preferably constructed having an inner metal portion 37 and an outer polymeric portion 39 (FIG. 3). In this manner the support posts provide increased structural rigidity as well as corrosion resistance. Moreover, tabs, supports and other structural enhancements (not shown) may be integrally formed onto the outer surface of the vertical support posts. The upper portion of the rear support posts 42 preferably includes an integral elbow portion 40 for attachment of a structural handle 82. The structural handle 82, shown in FIGS. 1–8, is linked to the elbow portion 40 of rear frame members 42 and extends rearwardly from the tray 52. The handle 82 includes a handgrip portion 84 which extends between the mounting arms 85 and is attached to the upper end 43 of the support posts 42 via a bolt assembly 150, or by any other fastener means well known in the art. The handgrip portion 84 provides a comfortable handhold to receive the fingers of both hands of the person pushing or pulling the cart 20.

Interconnecting the top end portions 36, 43 of the frame members 38, 42 is a storage box or tray 52 for storing gardening supplies or tools (not shown) so they can be easily accessed. The tray 52 comprises a generally rectangular floor or base 62, a vertical front wall 54, a rear wall 56, left and right side walls 58. The base 62 preferably includes a plurality of openings 70 of such a size as to permit draining of water, dirt, and other small particles of debris.

In a preferred embodiment, the tray 52 includes a plurality of integrally formed vertical sleeves 110 located at the corners of the tray, such that the support posts 38, 42 snugly fit into the sleeves 110. Similarly, the rear support posts 42 extend through sleeves 110 connected to the rear wall 56, such that the elbow 40 is located at or above the sleeve 110. In this manner the handle 82 is located at a convenient height for gripping by the user. Fasteners 150 are utilized to extend through suitable openings 152 formed in sleeves 110 to effect the final rigid securement. One of ordinary skill will recognize that a variety of fasteners as well as other fastening means well known in the art may alternatively be utilized.

Figure 5:
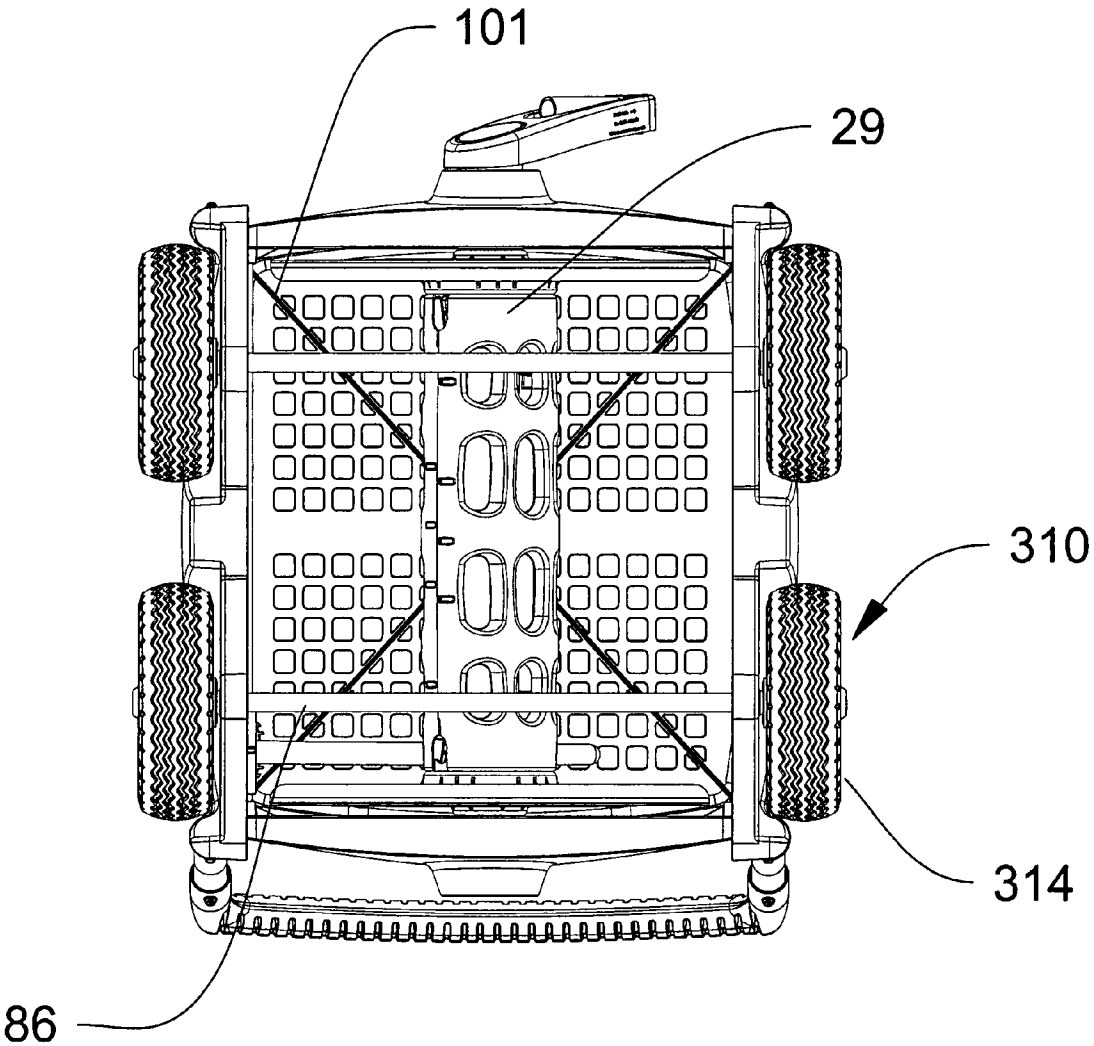
FIG. 5 is a bottom view of the instant invention.
Figure 6:
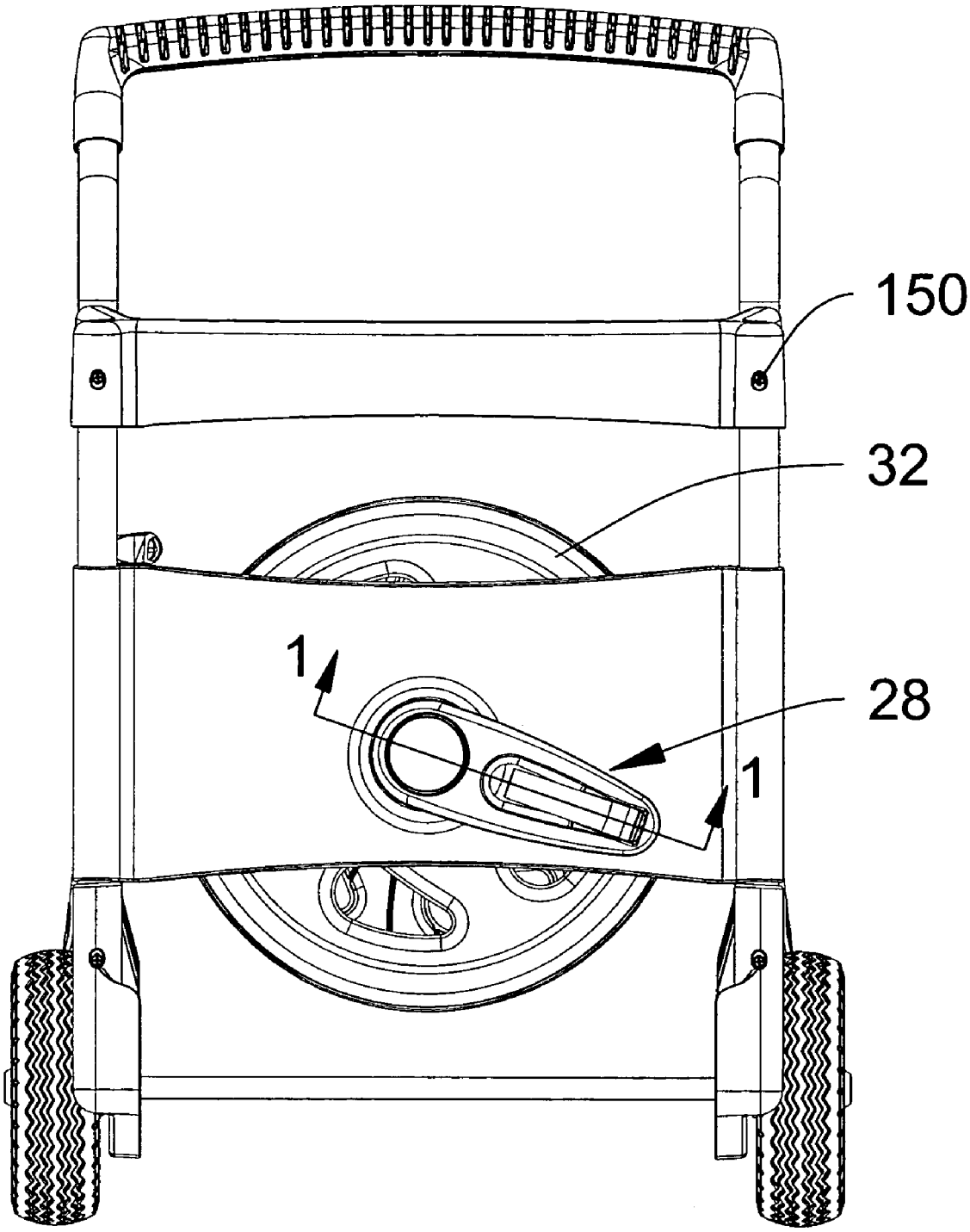
FIG. 6. is a front view of the instant invention.
Figure 7:
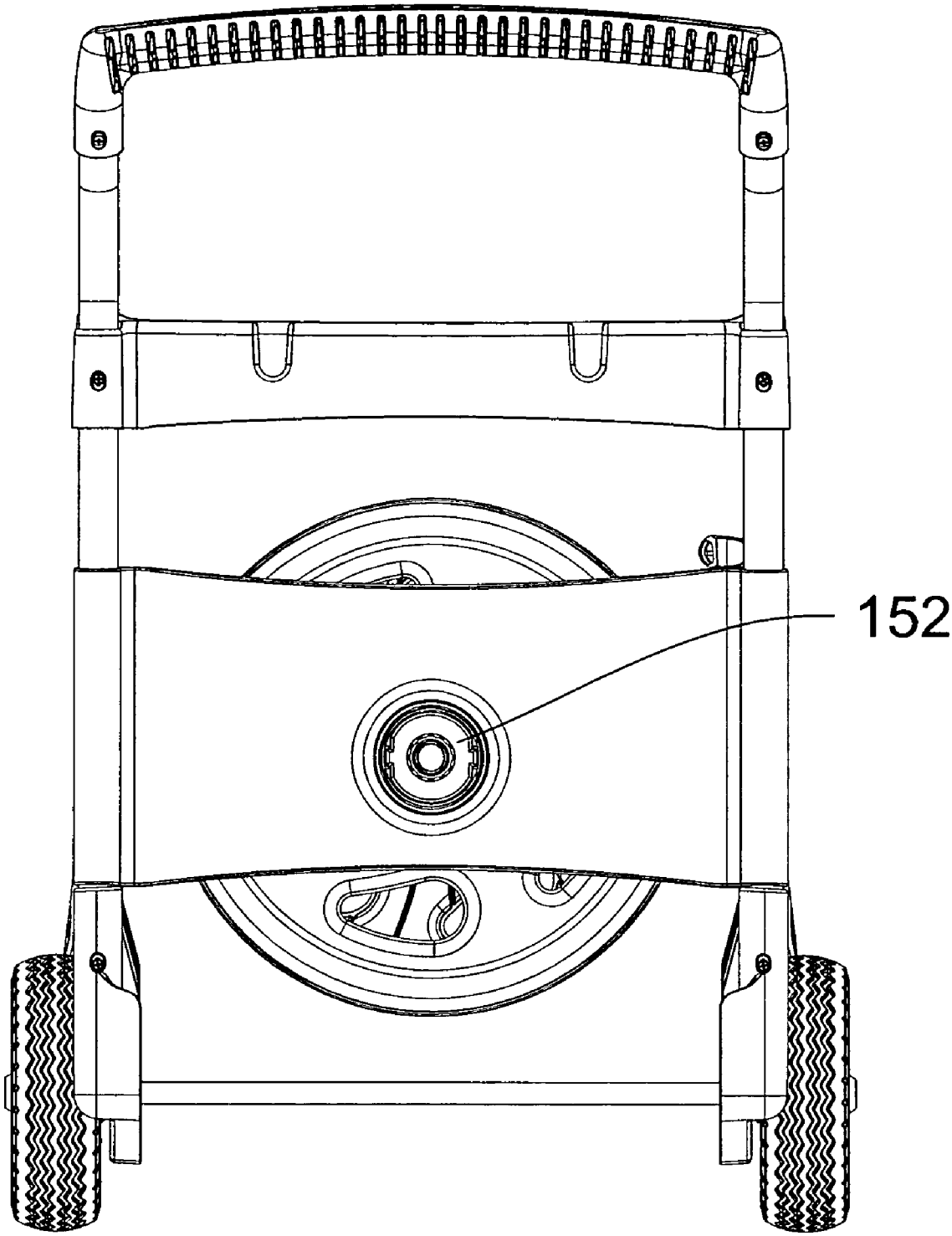
FIG. 7. is a rear view of the instant invention.

The tray 52 includes a plurality of vertical slots 74 formed within one or more of the tray walls, herein illustrated in rear wall 56, for storing the free end of a hose when not connected to a fluid source to prevent hose ends from dragging along the ground when the cart is moving. The slots 74 can be used to hold other tools, e.g. hose nozzle, or the like (not shown). The slots can include a retaining lip (not shown) to prevent objects from sliding out, as discussed in U.S. Pat. No. 6,086,073 herein incorporated by reference. As best seen in FIG. 5, the bottom surface of the tray can comprise additional material integrally attached thereto forming reinforcement ribs 101 for enhanced rigidity of the tray. In an alternative embodiment the tray may include metal reinforcements (not shown) integrally molded therein to provide additional rigidity and weight capacity.

In the preferred embodiment, the front and rear support posts 38 and 42 are constructed to extend through integral congruent sleeves 110 formed along at least one edge portion of a pair of structural panels 66, the corners of the upper tray 52 and the wheel support assemblies 48 for connection thereto. However other means of connection will be recognized by those skilled in the art, e.g. clips, split collars, clamps and the like. The generally rectangular shaped structural sides 66 are complementary to each other and both include centrally disposed journaled apertures 140 sized for receipt of hub portions 130, crank assembly and sliding seal arrangement as discussed below.

In one preferred embodiment, the front support posts 38 are constructed to extend through at least one of the integral sleeves 110 formed on the front edge portions of each pair of wheel support assemblies 48. Similarly, the rear support posts 42 are constructed to extend through each of the integral sleeves 110 formed on the rear edge portions of wheel support assembly 48. Fasteners 150 designed to extend through suitable openings 152 formed in sleeves 110 and vertical support members 38, 42 effect the final rigid securement. One of ordinary skill will recognize that a variety of fasteners as well as other fastening means well known in the art may alternatively be utilized.

Additionally, the enclosure includes a pair of generally horizontally guide rails 34 along which a movable hose guide 72 slides to facilitate even distribution of the hose 22 onto the spool 26. The pair of guide rails 42 are secured to and extend between the structural panels 66 and increase the structural integrity of the cart 20. The lower portion of the enclosure 21 includes a pair of spaced apart and opposing wheel support panels 48 for attaching floatation type tires 300.

Referring now to FIG. 3, there is shown the two substantially identical wheel support panels 48. Each wheel support panel 48 includes a hub, or aperture, 304. Two transverse axles 86 extend laterally across the cart 20 such that the end portion of each axle 86 extends through the hub 304 of each opposing wheel support panel 48 to rotatably secure four floatation wheels 300 thereto. Additionally, the wheel support panels 48 include gussets 49 extending between the hubs 304 and the outer wall of the support panels 48 to provide additional structural rigidity. In an alternative embodiment, not shown, the wheel support panels may include integrally formed metal to provide additional structural rigidity and weight capacity.

Figure 12:
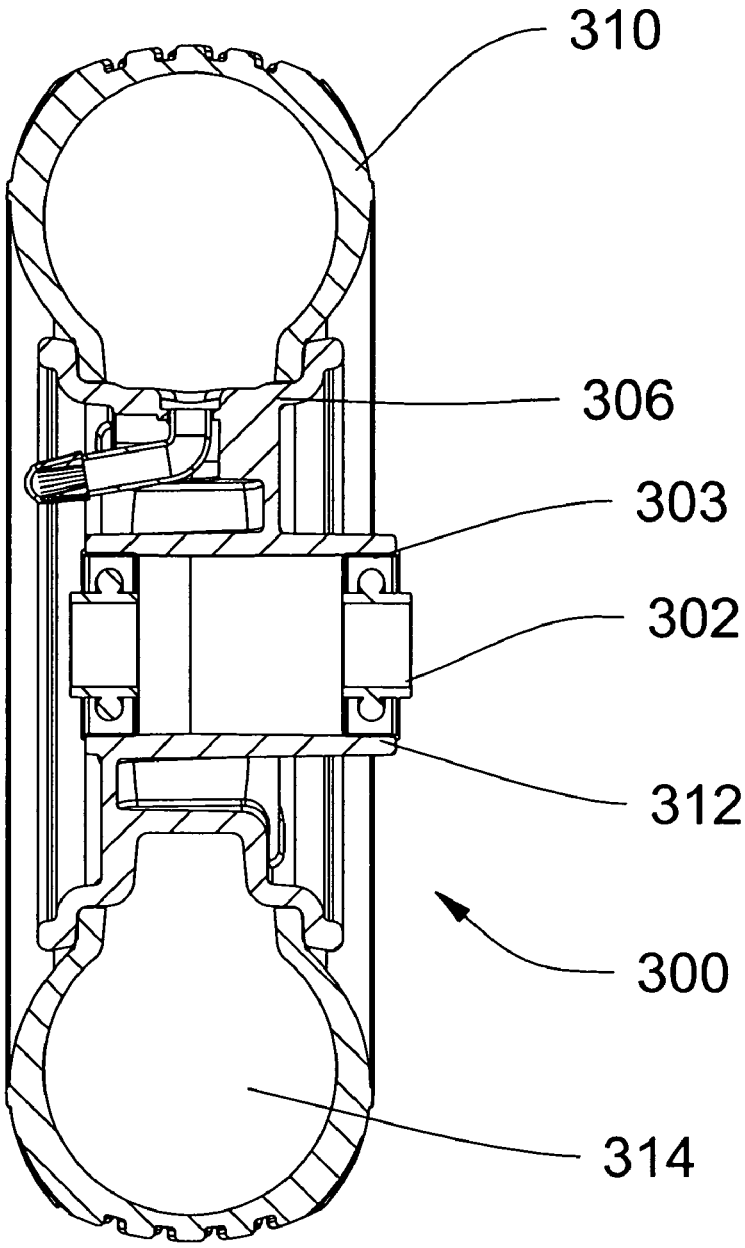
FIG. 12. is a cross sectional view of the floatation tires utilized in the instant invention taken along lines 2—2 of FIG. 8.

As shown in FIG. 12, each of the four wheel assemblies 300 include a rim 306 with a central opening 302 for receipt of the axle 86. In a preferred embodiment the rim 306 includes a bore 303 for mounting at least one bearing member 312, e.g. ball bearing, roller bearing or bushing. Such bearings 312 include an inner ring having an axial opening for receiving an axle therein and an outer ring seated within the bore 303 of the wheel. This facilitates rotation of the wheel and tire when the cart is moved. Moreover, the rim 306 can include radial spokes 308 (FIG. 2) extending radially from the central opening 302 for increased rigidity.

In a preferred embodiment, floatation tires 310, e.g. pneumatic tires are annularly and circumferentially placed around the outer circumference of rim 306 to provide shock absorption, large footprint, improved handling and maneuvering. The tire 310 may be made from any natural rubber, synthetic rubber or suitable combination thereof as is well known in the art. The floatation tires are preferably greater than 8 inches in diameter to substantially elevate the wheel support assemblies 48 above tall grass, rocks, etc. Additionally, as illustrated in FIGS. 5 and 13, the floatation tires 310 can include treads 314 for better traction.

Referring to FIG. 3, the spool assembly 26 includes a central hub 28 constructed from two identical halves 114 and 116 which are secured to each other and to the radially extending flanges 32. The connection can be accomplished via interlocking tabs or screws (not shown), such an arrangement can be viewed in U.S. Pat. No. 5,007,598 the contents of which are incorporated herein by reference. The hose 22 is wrapped around the reel 26 between the flanges 32. Centrally disposed in each flange 32 is an axial extending hub 130 which is inserted into the journaled apertures 140 formed in either of structural panel 66. In this manner the spool is rotatable about axis A (FIGS. 1, 2). The reel halves 114, 116 and flanges 32 can be made of plastic material such as, polyethylene, or any other plastic, metal or suitable combination thereof known in the art.

Figure 11:
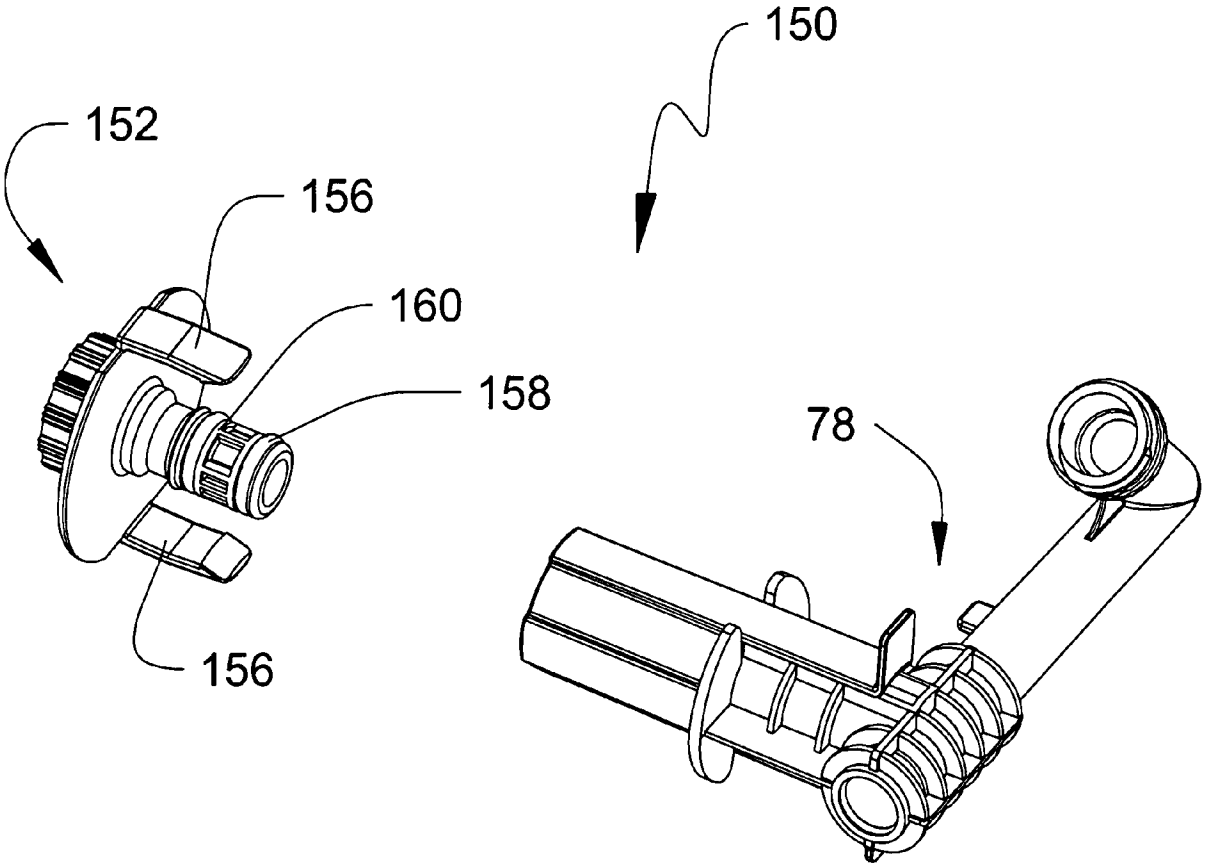
FIG. 11. is a perspective view of the sliding seal arrangement utilized in the instant invention.

As best illustrated in FIG. 3 and FIG. 11, the hose reel 26 includes a hose connector 150 composed of a out-tube coupler 78 and a in-tube coupler 152. The in-tube coupler 152 contains female threads for attachment to leader hose 80 (FIG. 1) which is in fluid communication with a pressurized fluid source. The in-tube coupler 152 can be mounted to either one of the vertical panels 66 at about the axis of rotation A of the reel 26. Alignment tabs 156 formed on the In-tube coupler 152 extend through the structural panel 66 and engage four equal spaced indentations (not shown) formed on the inside surface of the hub 130. The in-tube coupler 152 includes a molded outlet tube 158 having o-rings 160 for engagement with the interior of the out-tube 78 by a sliding seal arrangement so that the female adapter 152 remains fixed to the structural panels 66, while the out-tube 78 rotates with the reel 26 such that the female adapter 152 and out-tube 78 remain in fluid communication with one another as described in U.S. Patent. No. RE. 32,510, herein incorporated by reference. This arrangement permits rotation of the reel 26 without twisting or torquing internal components, while maintaining sealed fluid communication between the fluid supply and the hose. The coupling arrangement can also include a syringe type attachment means (not shown) for quick access to replaceable o-rings as discussed in U.S. Pat. No. 5,425,391 herein incorporated herein by reference.

Figure 10:
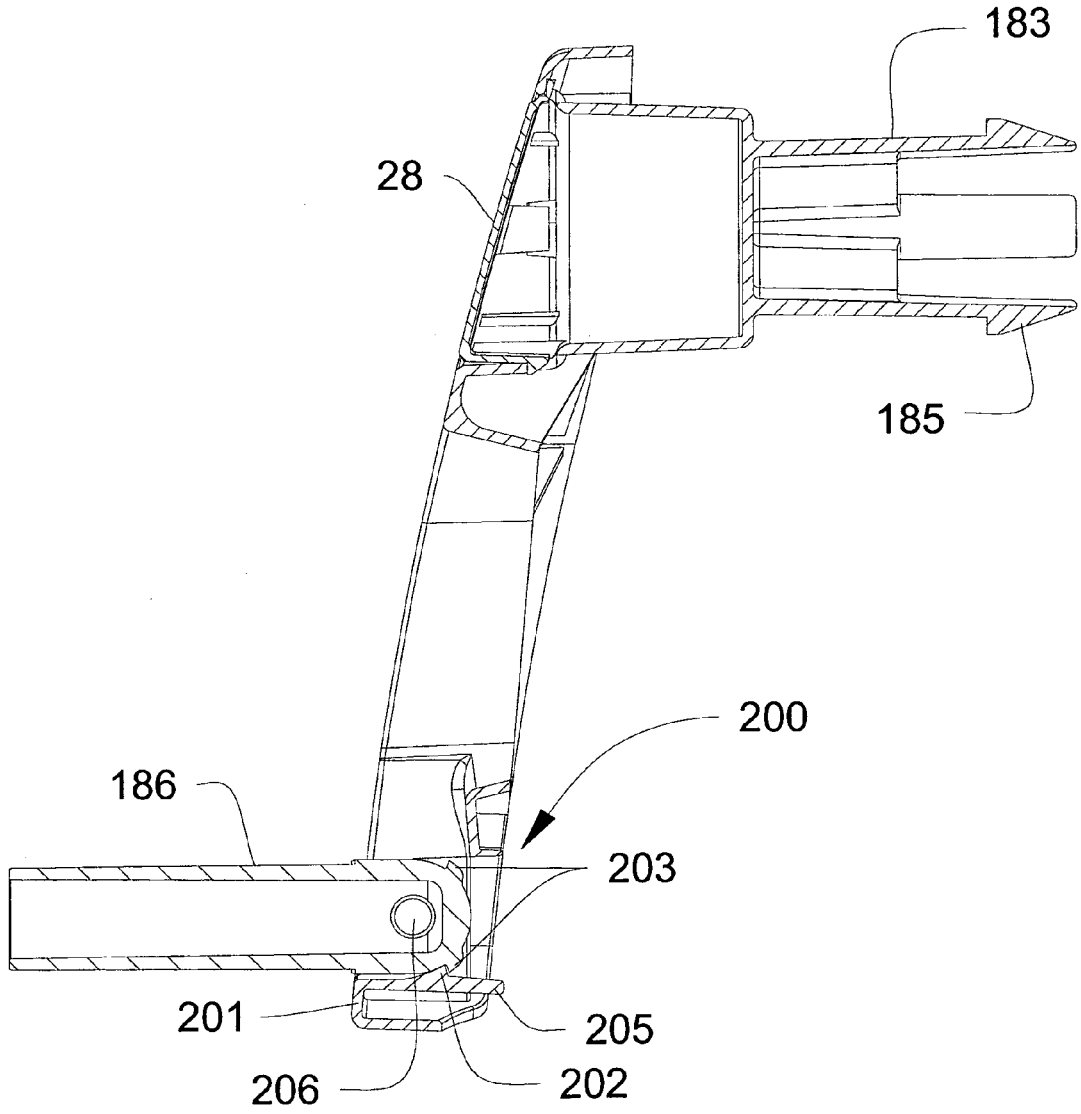
FIG. 10. is a cross sectional view of the folding crank handle of FIG. 9 taken along lines 1—1 of FIG. 6.

As illustrated in FIGS. 3, 10 and 11, the crank handle assembly 28 is operably connected to the reel 26 so that rotation of the crank 28 rotates the spool to pick-up or payout the hose 22 for storage or use. The crank 28 has a split axle 183 which telescopes into either hub 130 and resiliently engages the spaced indentations (not shown)

formed on the hub with tangs 184. The crank 28 is held in place by the interrupted flange 185. The split axle 183 can be compressed to remove the crank 28 from the reel 26 for placement on either end of the reel as desired.

The crank 28 is formed with an elongated depression which is shaped to accept the handle 186 when in the stored position. The handle 186 rotates about pin 206 fixed on the end of the crank 28 and journaled to the end of the handle 186. The connection 200 between the handle 186 and the crank 28 permits repeated locking movement of the handle 186 from the stored position to the operative position.

The handle 186, shown in FIGS. 10–11, turns in the operator's hand as the reel is manually rotated to wind the hose 22. As shown in FIG. 10, the handle 186 has a flange 203 which turns about the pin 206 in conjunction with the handle 186 to cooperate with locator ridge 202 on locking tab 205 as the handle 186 is manually rotated to the operative position to lock the handle in place. The handle may thereafter be released by depressing the locking tab 205 allowing the handle 186 to be rotated to the stored position.

Figure 8:
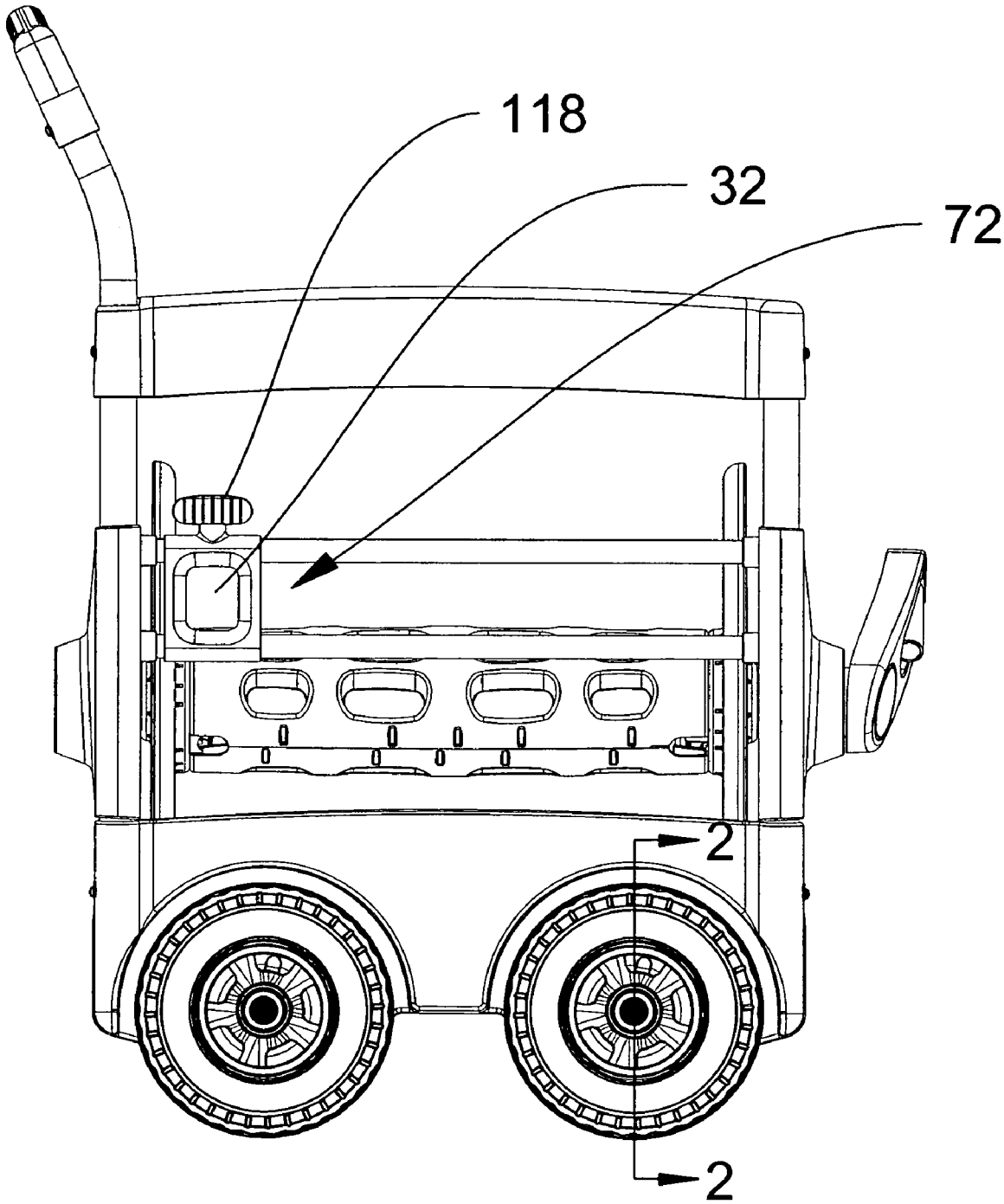
FIG. 8. is a left side view of the instant invention.
Figure 9:
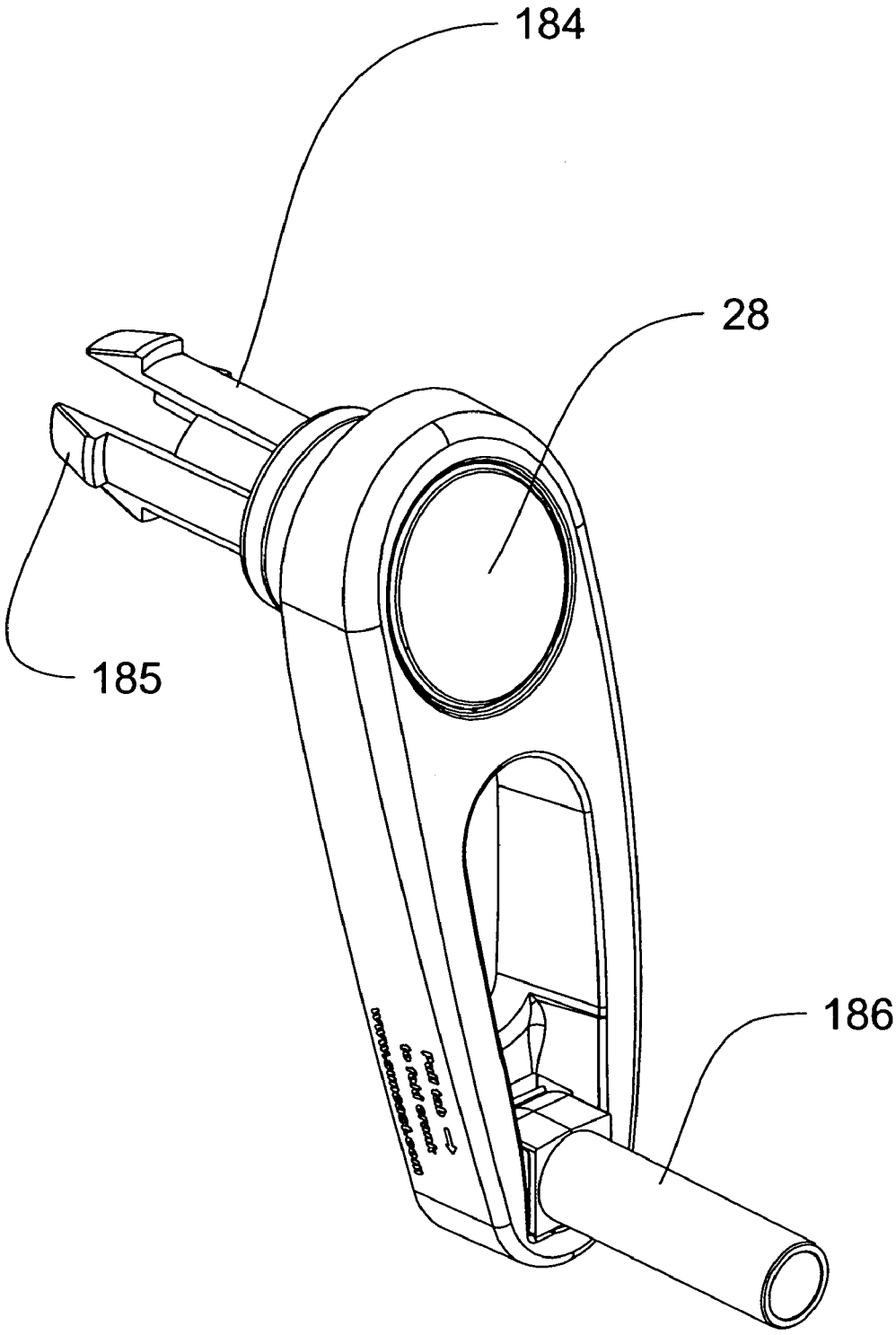
FIG. 9. is a perspective of the folding crank handle utilized by the instant invention.

Referring to FIG. 8, the hose guide 72 prevents the user from touching the potentially dirty hose when winding up the hose. The hose guide 72 comprises an opening 32 though which the hose 22 passes and a handle 118 for gripping by the user. By rotating the spool 26 in concert with reciprocating the hose guide 72, the user is able to neatly and evenly distribute the hose 22 across the spool 26, with adjacent turns of each layer aligned next to the previous one. The hose reel cart 20 provides a "base-station" when coupled to a water or air outlet; e.g., a water spigot or source of compressed air, so that an operator can pay-out as much hose 22 as needed while the leader hose 78 remains coupled in fluid communication with the water or air supply (not shown).

In a preferred embodiment the various enclosure members, e.g. handle portion 85, crank 28, wheel support assemblies 48, tray 52, spool 26, flanges 32, hose guide 72, rim 306 and structural panels 66 are formed primarily from high density polyethylene (HDPE) using an injection molding process, this provides increased corrosion resistance and thereby helps to decreases the overall weight of the cart. Those skilled in the art will recognize that there are other various high strength polymeric (plastic) material, such as polystyrene or the like that can be used to form the above mentioned enclosure members. Additionally, the various enclosure members can include a plurality of reinforcing metal members and or ribs 100 (FIG. 3) for additional structural strength and support, without detracting from the aesthetic appearance of the cart once assembled.

Referring to FIG. 3, in the preferred embodiment the support posts 38, 42, guide rails 64 and axles 86 are made from metal and include an impact resistant coating such as polyethylene or polypropylene, as disclosed in U.S. Pat. No. 5,998,552, the contents of which are incorporated herein by reference. The plastic coating protects the steel frame members from water, liquid fertilizer, corrosive chemicals and other liquid to prevent rust and corrosion of the metal, while providing structural rigidity to the cart 20. Additionally, the metal members may be hollow or extruded forms which will also aid in decreasing the overall weight of the assembly without sacrificing rigidity. One of ordinary skill will recognize the shape of the tubular members is not restricted and can be circular, oval, rectangular, etc. In yet a further alternative embodiment tabs, supports and other structural enhancements (not shown) may be integrally formed onto the outer surface of the metal vertical support posts.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objects and obtain the ends and advantages mentioned, as well as those inherent therein. Any compounds, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A portable hose reel cart for windably holding an elongated hose member and for use in transporting said hose member between a storage location and a use location; said hose reel cart comprising:

an enclosure assembly defined by plastic coated steel corner posts and polymeric structural panels extending therebetween, said enclosure assembly including a spool positioned between at least two of said structural panels and operably connected thereto for rotation of said spool about an axis of rotation, said spool having a hub defining said axis of rotation and a pair of flanges at opposing ends of said hub and perpendicular to said axis of rotation, a crank assembly releasably insertable through a centrally located aperture located in said structural panels, thereby providing direct coupling to said spool for providing manual rotational movement of said spool in relation to said enclosure, a hose coupler including a sliding seal arrangement releasably insertable through a centrally located aperture located in said structural panels, said sliding seal arrangement constructed and arranged for connection to a pressurized fluid source in a manner that allows rotation of said spool about said axis of rotation.

2. The hose reel cart in accordance with claim 1 including a manual guide assembly for guiding a hose wound onto said spool; wherein said hose is manually distributed uniformly and smoothly across said spool for a compact storage configuration.

3. The hose reel cart in accordance with claim 2, wherein said manual guide includes: a pair of guide rails secured to and extending generally transverse to said structural panels; said pair of guide rails substantially parallel and spaced apart in relation to one another and said axis of rotation of said spool; and a guide manually slidable along said rails; wherein manually guided distribution of said hose about said spool is facilitated.

4. A portable hose reel cart for windably holding an elongated hose member and for use in transporting said hose member between a storage location and a use location; said hose reel cart comprising:

two substantially vertical rear corner posts, each having an upper end and a lower end, said rear corner posts being constructed of an inner metal portion and an outer polymeric portion;

two substantially vertical front corner posts, each having an upper end and a lower end, said front corner posts being constructed of an inner metal portion and an outer polymeric portion;

a tray including a rectangular shaped base, an upward extending front wall, an upward extending rear wall, two upwardly extending sidewalls therebetween and four corner sleeves, said corner sleeves constructed and arranged to cooperate with said upper ends of said front and said rear corner posts;

a pair of opposingly oriented structural wheel support panels extending between said front and said rear corner posts, each said wheel support panel including a front and a rear sleeve, wherein said front sleeve is constructed and arranged to cooperate with said lower end of said front corner posts and wherein said rear sleeve is constructed and arranged to cooperate with said lower end of said rear corner posts;

at least two pneumatic floatation tire assemblies rotatably secured to each of said wheel support panels;

a pair of opposingly oriented structural panels being disposed in parallel spaced apart relation with respect to each other and disposed substantially transverse with respect to said pair of wheel support panels, said structural panels each including a centrally located aperture constructed and arranged to accept a crank or a hose coupler, each said structural panel also including a sleeve integrally formed onto each end of said structural panel, wherein said sleeves are constructed and arranged to cooperate with and extend between either said front corner posts or said rear corner posts to define an enclosure;

a structural handle member, said structural handle member including a gripping portion, a first and a second distal end, and a pair of sleeve portions, said sleeve portions integrally formed into each of said first and said second distal ends of said gripping portion, said sleeve portions constructed and arranged to cooperate with said upper ends of said rear corner posts;

a spool positioned between said structural panels and operably connected thereto for rotation of said spool about an axis of rotation, said spool having a hub defining said axis of rotation and a pair of flanges at opposing ends of said hub and perpendicular to said axis of rotation;

a crank assembly releasably insertable through one of said structural panel centrally located apertures, thereby providing direct coupling to said spool for providing manual rotational movement of said spool in relation to said enclosure;

a hose coupler including a sliding seal arrangement releasably insertable through a centrally located aperture in one of said structural panel centrally located apertures, said sliding seal arrangement constructed and arranged for connection to a source of pressurized fluid in a manner that allows rotation of said spool about said axis of rotation.

5. The hose reel cart in accordance with claim 4 wherein said tray is constructed of polymeric material.

6. The hose reel cart in accordance with claim 4 wherein said tray is constructed of a combination of metal and polymeric material.

7. The hose reel cart in accordance with claim 4 wherein said base portion of said tray includes a plurality of drainage holes therein.

8. The hose reel cart in accordance with claim 4 wherein said tray rear wall includes at least one slot integrally formed therein, wherein said at least one slot is constructed and arranged for retaining a hose end.

9. The hose reel cart in accordance with claim 4, wherein said crank assembly includes a handle connected to said crank, said handle having a releasable lock securing said handle between a parallel position with said crank and a perpendicular position to said crank, said handle movable between said positions when said lock is released.

10. The hose reel cart in accordance with claim 4, wherein each said floatation wheel assembly includes an aperture through which an axle extends to rotatably secure a pneumatic tire thereto.

11. The hose reel cart in accordance with claim 10, wherein each wheel assembly aperture comprises a bearing portion through which said axle extends to facilitate rotational movement of said tire.

12. The hose reel cart in accordance with claim 11, wherein said bearing portion includes a member from a group consisting essentially of: a bushing, a roller bearing or a ball bearing.

13. The hose reel cart in accordance with claim 4, including a manual guide assembly for guiding a hose wound onto said spool; wherein said hose is manually distributed uniformly and smoothly across said spool for a compact storage configuration.

14. The hose reel cart in accordance with claim 13, wherein said manual guide includes: a pair of guide rails secured to and extending generally transverse to said structural panels; said pair of guide rails substantially parallel and spaced apart in relation to one another and said axis of rotation of said spool; and a guide manually slidable along said rails; wherein manually guided distribution of said hose about said spool is facilitated.

15. The hose reel cart in accordance with claim 4, wherein said molded tray, said pair of wheel support assemblies, said pair of structural panels, said spool and said crank assembly are composed from high density polyethylene.

16. The hose reel cart in accordance with claim 4, wherein said corner posts, said molded tray, said pair of wheel support assemblies and said pair of structural panels, are composed from a combination of metal and at least one polymeric resin.

* * * * *